United States Patent [19]

Carmichael

[11] 4,139,059

[45] Feb. 13, 1979

[54] WELL CASING HANGER ASSEMBLY

[75] Inventor: James T. Carmichael, Shreveport, La.

[73] Assignee: W-K-M Wellhead Systems, Inc., Shreveport, La.

[21] Appl. No.: 859,416

[22] Filed: Dec. 12, 1977

[51] Int. Cl.[2] ..... E21B 43/10

[52] U.S. Cl. ..... 166/208; 285/4

[58] Field of Search ..... 166/208, 213, 214; 285/2, 3, 4

[56] References Cited

U.S. PATENT DOCUMENTS

| | | | |
|---|---|---|---|
| 3,097,697 | 7/1963 | States | 166/208 X |
| 3,335,802 | 8/1967 | Seyffert | 166/214 X |
| 3,420,308 | 1/1969 | Putch | 166/208 |
| 3,893,717 | 7/1975 | Nelson et al. | 166/208 |
| 3,918,747 | 11/1975 | Putch et al. | 285/4 |

*Primary Examiner*—Ernest R. Purser
*Assistant Examiner*—Richard E. Favreau
*Attorney, Agent, or Firm*—Eugene N. Riddle

[57] ABSTRACT

A well casing hanger for suspending an inner string of well casing at a predetermined location in an outer casing string, including a pair of semi-circular segments each having a plurality of outwardly biased latching fingers extending upwardly from an externally threaded semi-circular support base. An internally threaded connecting ring is threaded onto external screw threads on the casing string and onto the semi-circular support bases which are positioned around the hanger body to secure the segments on the string until the inner casing string is positioned accurately. The weight of the inner casing string shears the connecting ring to permit the latching fingers to be releasably locked in an outwardly urged latched position.

8 Claims, 7 Drawing Figures

FIG. 4
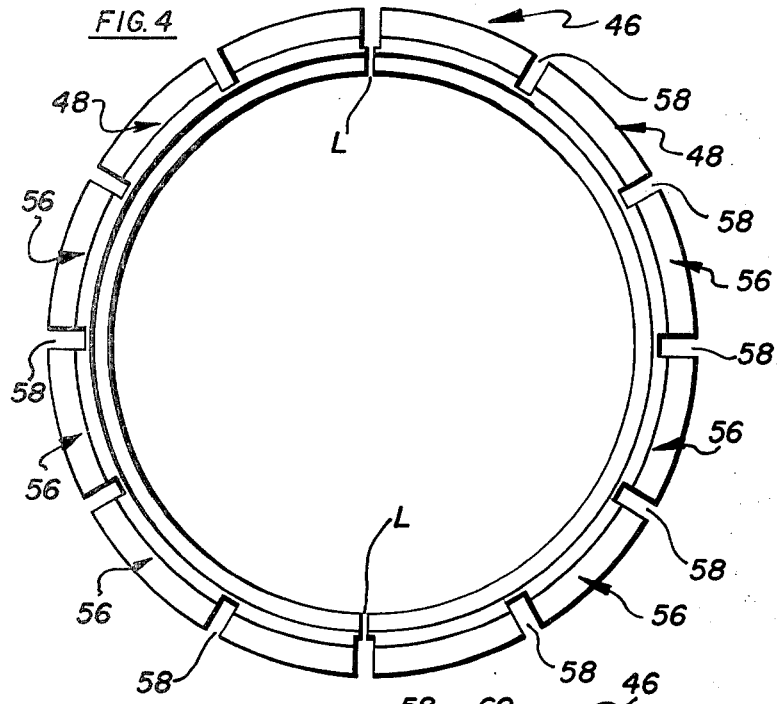
FIG. 6
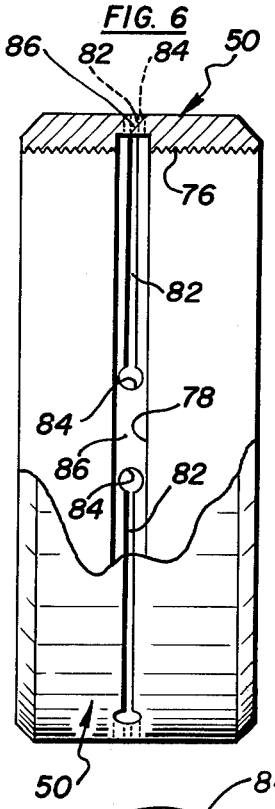
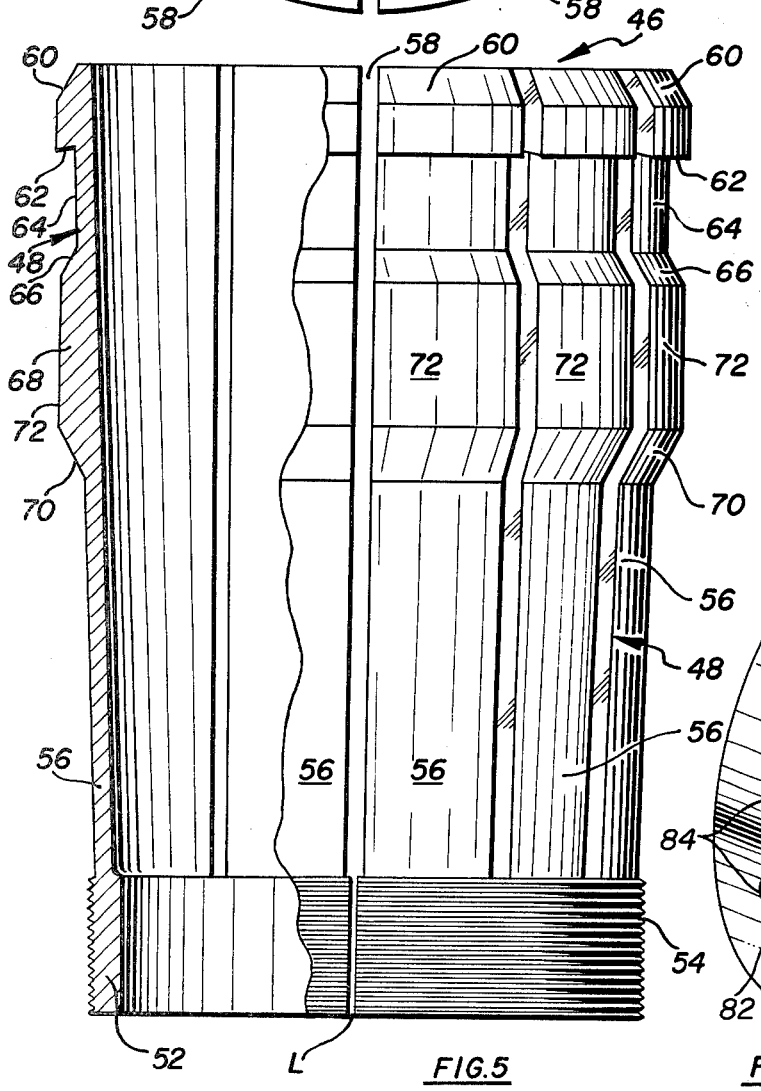
FIG. 5
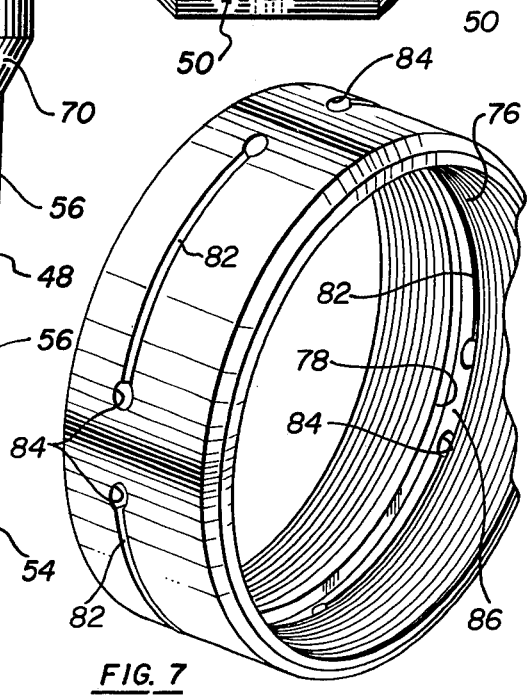
FIG. 7

WELL CASING HANGER ASSEMBLY

BACKGROUND OF THE INVENTION

Heretofore, well casing hangers for suspending an inner string of well casing have utilized so-called locking rings which are continuously urged outwardly and fit in receiving grooves in the inner wall of an outer casing string. Such locking rings have also employed releasable retaining means which are sheared by the weight of the inner pipe string when the inner pipe string is accurately positioned relative to the outer casing string and thereby permits the locking ring to be locked outwardly in the receiving grooves so that the ring may not be inadvertently moved inwardly to release the inner pipe string.

Such prior art devices, such as shown in U.S. Pat. No. 3,893,717 dated July 8, 1975 and U.S. Pat. No. 3,420,308 dated Jan. 7, 1969, have usually utilized either a separate spring element inside or behind the locking ring to urge the ring outwardly, or a one-piece integral ring split longitudinally which continuously expands outwardly. Separate shear rings held in position by shear pins which shear at a predetermined pipe load have been utilized heretofore for the releasable retaining means.

While the above type hangers operate satisfactorily, the use of separate spring elements increases the number of parts which increases the possibility of malfunctioning. Further, the use of a separate shear ring which is separately secured by a plurality of shear pins is time consuming in positioning on the inner pipe string and engages the locking ring in abutting relation only when the locking ring expands outwardly.

DESCRIPTION OF THE INVENTION

The present invention is directed to a pipe hanger assembly suspending an inner pipe within an outer pipe in which a hanger body has a lower end for connection to the inner pipe string to be suspended and the upper end is adapted for releasable connection to a well tool for selective removal of the inner pipe string by pulling the inner pipe string upwardly if desired.

A locking assembly around the hanger body includes a pair of semi-circular segments each having a lower externally threaded arcuate support base and a plurality of outwardly biased latching fingers extending upwardly from the associated base. An internally threaded connecting ring is threaded on external screw threads on the inner pipe string and onto the externally threaded support bases which are positioned about the hanger body to secure the segments on the hanger body until the inner string is positioned accurately. The weight of the inner pipe string shears the connecting ring to permit the latching fingers to be releasably locked in an outwardly biased position by an enlarged diameter portion of the hanger body which moves behind the fingers.

The semi-circular segments are easily positioned about the hanger body and the shear ring which has been previously threaded onto the hanger body is easily threaded onto the semi-circular segments to hold the segments in position. Such an arrangement permits the locking assembly to be easily positioned in a minimum of time.

BRIEF DESCRIPTION OF THE DRAWINGS

FIG. 4 is a top plan of the semi-circular segments having the outwardly biased latching fingers thereon;

FIG. 5 is an elevational view, partly in section, showing the semi-circular segments illustrated in FIG. 4 removed from the hanger body;

FIG. 6 is a sectional view, partly in elevation, showing the connecting ring which secures the semi-circular segments in position on the hanger body and illustrating the reduced thickness portion therein; and FIG. 7 is a perspective of the connecting ring shown in FIG. 6.

Referring now to the drawings, a casing hanger is generally indicated at 10 and is shown in FIG. 1 as being lowered by a suitable tool, (not shown) within an outer casing 12. FIGS. 2 and 3 show a hanger coupling 14 which has a lower outer casing string at 16 secured thereto. Hanger coupling 14 has an upper groove or recess defining an inner recessed surface 18, an upwardly inclined lower shoulder 20, and a tapered upper cam surface 22. A lower groove in recess in hanger coupling 14 defines a recessed surface 24, an upper tapered cam surface 26, and a lower tapered surface 28. Outer casing 12 is suitably connected at its lower end (not shown) to hanger coupling 14.

Figure 1:
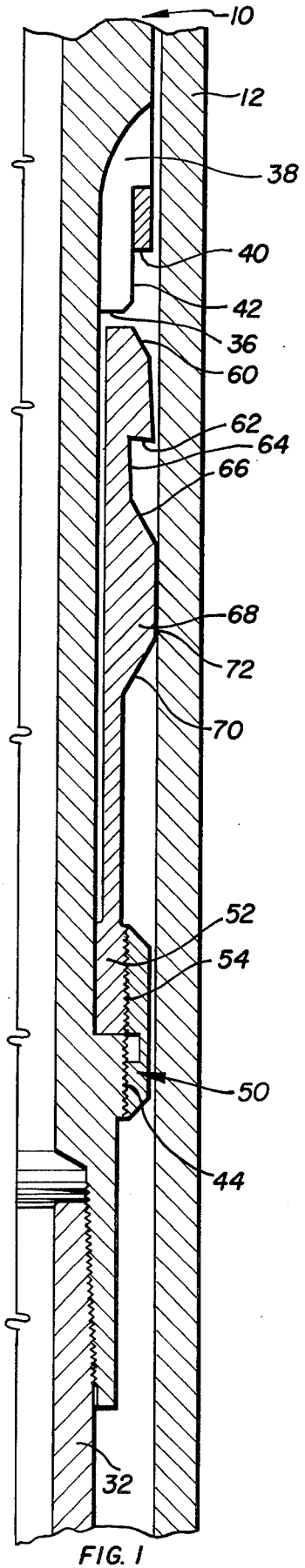
FIG. 1 is a longitudinal sectional view of the latching or locking assembly in position on a hanger body having an inner pipe string suspended therefrom and being run in an outer pipe string or casing.

Hanger 10 has a hanger body generally indicated at 30 with a lower inner pipe string 32 secured to the internally threaded lower end of hanger body 30. An intermediate portion of hanger body 30 has an outer recessed cylindrical surface 32 defined between a lower annular abutment 34 and an upper annular abutment 36. A plurality of circumferentially spaced axially extending slots are shown at 38 to provide a flow passage in the annular space formed between the outer casing and hanger body 30. An upper stop shoulder is defined at 40 and an enlarged diameter portion on hanger body 30 forms a cylindrical locking surface 42, intermediate stop surface or shoulder 40 and upper abutment 36. The lower end of hanger body 30 is externally threaded at 44.

A locking assembly for releasably supporting hanger body 30 within hanger coupling 14 is indicated generally at 46 and includes a pair of semi-circular segments 48 which fit around hanger body 30 and a connecting shear ring illustrated at 50 which secures semi-circular segments 48 on hanger body 30. Semi-circular segments 48 are identical and are first formed in the shape of a generally cylindrical ring, then cut or sawed along lines "L" into two semi-circular segments 48. Each segment 48 has a lower base 52 with external screw threads 54 thereon. A plurality of upwardly extending latching fingers 56 extend upwardly from base 52 and are formed integrally with base 52. Fingers 56 are separated by axially extending slots 58. Each finger 56 has an upper hook like portion defined by an upper cam surface 60 and a notched portion which forms a downwardly inclined stop shoulder 62, a recessed arcuate surface 64, and an intermediate cam surface 66. Annular boss 68 has a lower cam surface 70 and an outer arcuate surface 72 which is adapted to ride along the inner wall surface of outer casing 12 as hanger body 30 is being lowered within outer casing 12.

A connecting shear ring 74 is internally threaded at 76 and has an inner annular groove 78 extending about its entire inner circumference to form a weakened reduced thickness portion. Formed in the reduced thickness portion 80 are four segmental arcuate cuts each around eighty degrees (80°) and indicated at 82. Each cut 82 terminates at each end thereof at an enlarged opening 84. Thus, a total of eight (8) openings 84 are provided leaving four (4) sections indicated at 86 between cuts 82 as shown in FIGS. 6 and 7. Sections 86 can be varied in length and thickness to shear at a predetermined pipe loading.

To assemble the locking assembly about hanger body 30, connecting shear ring 50 is threaded onto external screw threads 44 with the upper end of shear ring 50 being below abutment 34. Then, the two semi-circular segments 48 are positioned about hanger body 30 with their lower ends fitting or resting on lower abutment 34. After segments 48 are placed around hanger body 30, shear ring 44 is rotated to thread onto the external screw threads 54. A suitable upper stop 90 is provided at the upper end of base 52 to stop the upward threading of ring 50. Thus, a very simple and economical manner of positioning the locking assembly on hanger body 30 is provided in a minimum of time and effort.

Figure 2:
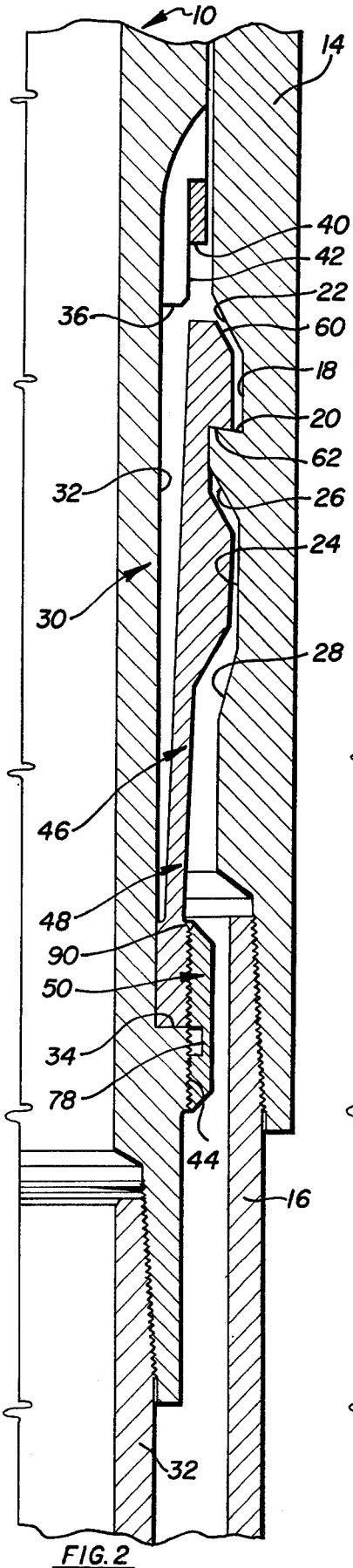
FIG. 2 is a longitudinal sectional view similar to FIG. 1 but showing latching fingers of the locking assembly received within recesses in the outer pipe casing prior to the shearing of the shear ring.
Figure 3:
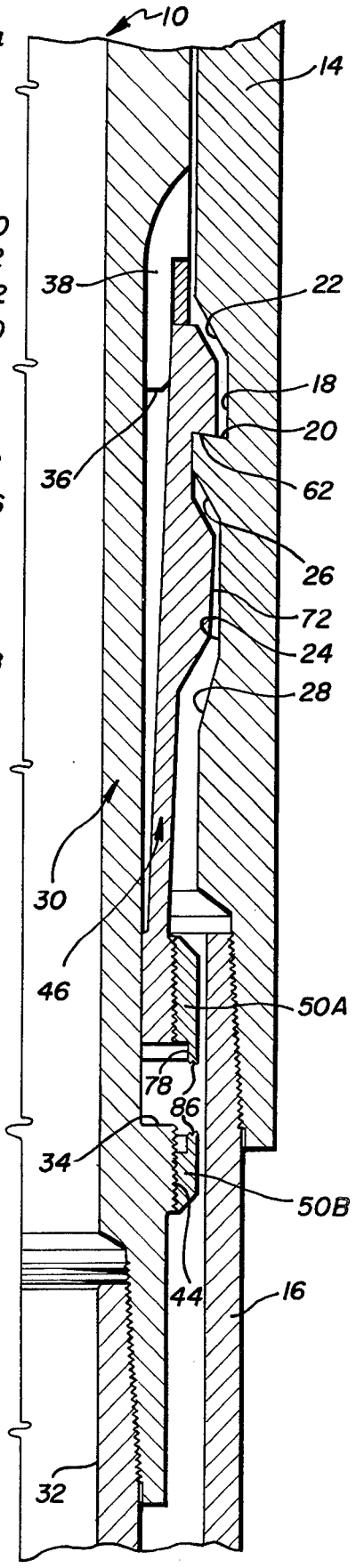
FIG. 3 is a longitudinal sectional view similar to FIGS. 1 and 2 showing the locking assembly after the shearing of the connecting ring and after the inner casing string has moved downwardly with an enlarged diameter locking surface of the hanger body moving behind the latching fingers to hold the fingers in outwardly latched position.

In operation, hanger body 30 which is suitably secured to a tool (not shown) is lowered within outer casing 12 as illustrated in FIG. 1 and arcuate surfaces 72 of latching fingers 56 ride along the inner surface of outer casing 12 as illustrated in FIG. 1. Fingers 56 are continuously urged outwardly as they are constructed and tempered in such a manner as to have an outer bias from their upper free ends. When the upper ends of latching fingers 56 are positioned adjacent recessed surfaces 18 and 24, fingers 56 move outwardly and stop shoulder 62 engages shoulder 20 as shown in FIG. 2. Upon further lowering of casing string 32, the weight of casing string 32 results in the shearing of connecting ring 50 about sections 86 with upper section 50A being separated from lower section 50B as shown in FIG. 3. The further lowering of hanger body 30 causes locking surface 42 to move behind fingers 56 as shown in FIG. 3 and upper stop 40 engages the upper end of fingers 56 as shown in FIG. 3 to hold hanger body 30 in a releasably locked latched position. In this position, fingers 56 are prevented from being urged inwardly by locking surface 42. If it is desired to move inner pipe string 32 upwardly, a suitable tool may be again connected to hanger body 30 and an upward lifting action on hanger body 30 will result in fingers 56 being cammed inwardly by cam surfaces 22 and 26 on hanger coupling 14 to permit the upward movement of inner casing string 32.

What is claimed is:

1. A hanger assembly for suspending an inner pipe string within and from an outer casing comprising:

an elongated tubular hanger body with upper and lower ends, the upper end adapted for releasable connection to a well tool and the lower end adapted for connection to an inner pipe string;

said hanger body having a recessed intermediate portion with external screw threads subjacent said recessed portion and an enlarged diameter locking surface superjacent said recessed portion; and a locking assembly around the hanger body received within the recessed intermediate portion having a lower base and a plurality of latching fingers extending upwardly from the lower base with the free ends thereof being self-urged outwardly, said locking assembly including a separate connecting ring having internal screw threads in threaded engagement with the hanger body and in threaded engagement with said lower base to secure the latching fingers in position on the hanger body, said connecting ring having a weakened portion whereby said ring fails about said weakened portion from the weight of the inner pipe string to permit said locking fingers to slide axially along the hanger body over the locking surface whereby the locking surface holds the upper ends of the fingers in an expanded condition for preventing inner movement of the upper ends of said fingers.

2. A hanger assembly as set forth in claim 1, wherein the weakened portion of said ring comprises a reduced thickness intermediate the width of said ring so that said ring is sheared about said reduced thickness upon the application of the weight of the inner pipe string.

3. A hanger assembly as set forth in claim 1, wherein said ring has an annular groove about its inner circumference and a plurality of contiguous arcuate cuts through the ring are formed in said groove thereby to provide said weakened portion.

4. A hanger assembly as set forth in claim 3, wherein each of said arcuate cuts includes a segment of around eighty degrees (80°) and each cut terminates at each end at an enlarged opening.

5. A hanger assembly for suspending an inner pipe string within and from an outer casing comprising:

an elongated tubular hanger body with upper and lower ends, the upper end adapted for releasable connection to a well tool and the lower end adapted for connection to an inner pipe string;

said hanger body having a recessed intermediate portion defined between upper and lower opposed abutments, external screw threads subjacent said lower abutment, an enlarged diameter generally cylindrical locking surface immediately superjacent said upper abutment, and a stop shoulder superjacent said locking surface; and a locking assembly received within the recessed intermediate portion around the hanger body having a lower base resting on said lower abutment and a plurality of latching fingers extending upwardly from the lower base with the free ends thereof being self-urged outwardly, said locking assembly including a separate connecting ring having internal screw threads in threaded engagement with the hanger body and in threaded engagement with said lower base to secure the latching fingers in position on the hanger body, said connecting ring having a weakened portion intermediate its width whereby said ring is sheared about said weakened portion from the weight of the inner pipe string to permit said locking fingers to slide axially along the hanger body over the locking surface into abutting contact with said stop shoulder whereby the locking surface holds the upper ends of the fingers in an expanded condition for preventing inner movement of the upper ends of said fingers.

6. A hanger assembly as set forth in claim 5, wherein said connecting ring has an annular groove about its inner circumference and a plurality of cuts through the ring are made in the groove to provide said weakened portion.

7. A hanger assembly as set forth in claim 5, wherein said locking assembly comprises two generally semi-circular segments each having a semi-circular base and a plurality of fingers extending upwardly therefrom.

8. A hanger assembly as set forth in claim 7, wherein each of said fingers has an enlarged diameter hook portion adjacent its upper end and an enlarged boss intermediate its upper end and the base thereof, said hook portion defining a lower downwardly facing abutment adapted to engage upwardly facing abutment on the outer casing.

* * * * *